US009586776B2

(12) United States Patent
Uchino et al.

(10) Patent No.: US 9,586,776 B2
(45) Date of Patent: Mar. 7, 2017

(54) CONVEYANCE APPARATUS AND IMAGE RECORDING APPARATUS PROVIDED WITH THE SAME

(71) Applicant: Brother Kogyo Kabushiki Kaisha, Nagoya-shi, Aichi-ken (JP)

(72) Inventors: Yuta Uchino, Nagoya (JP); Wataru Sugiyama, Nishio (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/083,709

(22) Filed: Mar. 29, 2016

(65) Prior Publication Data

US 2016/0289021 A1 Oct. 6, 2016

(30) Foreign Application Priority Data

Mar. 31, 2015 (JP) ..... 2015-074344

(51) Int. Cl.
*B65H 5/06* (2006.01)
*B65H 29/12* (2006.01)

(52) U.S. Cl.
CPC ..... *B65H 5/06* (2013.01); *B65H 5/062* (2013.01); *B65H 29/12* (2013.01); *B65H 29/125* (2013.01); *B65H 2404/142* (2013.01); *B65H 2404/143* (2013.01); *B65H 2404/144* (2013.01); *B65H 2404/1421* (2013.01); *B65H 2404/1441* (2013.01); *B65H 2404/152* (2013.01); *B65H 2404/1521* (2013.01)

(58) Field of Classification Search
CPC ..... B65H 5/06; B65H 5/062; B65H 29/12; B65H 29/125; B65H 2403/51; B65H 2404/1421; B65H 2404/142; B65H 2404/143; B65H 2404/144; B65H 2404/1441; B65H 2404/152; B65H 2404/1521
USPC ..... 271/273, 274
See application file for complete search history.

(56) References Cited

U.S. PATENT DOCUMENTS 4,272,069 A * 6/1981 Matthews ..... B65H 29/6627 271/182
5,988,635 A * 11/1999 Ohshima ..... B65H 5/06 271/109

(Continued)

FOREIGN PATENT DOCUMENTS

JP 2012-071563 A 4/2012

*Primary Examiner* — David H Bollinger
(74) *Attorney, Agent, or Firm* — Banner & Witcoff, Ltd.

(57) ABSTRACT

There is provided a conveyance apparatus including: a conveyance roller; a plurality of driven rollers; a plurality of roller holders; an biasing member biasing each of the roller holders toward a first position; and a movable member having a plurality of cam portions. Each of the cam portions has: a first inclined surface abutting against one of the roller holders from a side of one of the driven rollers, during a movement process of the movable member from a third position to a fourth position, to thereby move one of the roller holders from the first position toward a second position; and a second inclined surface arranged upstream of the first inclined surface in a moving direction, and abutting against one of the roller holders from the side of one of the driven rollers, during the movement process of the movable member from the third position to the fourth position.

8 Claims, 12 Drawing Sheets

(56) References Cited

U.S. PATENT DOCUMENTS

| | | | | |
|---|---|---|---|---|
| 6,098,863 | A * | 8/2000 | Hevenor | B41J 11/0055 226/15 |
| 6,135,446 | A * | 10/2000 | Thiemann | B65H 7/10 271/228 |
| 6,168,153 | B1 * | 1/2001 | Richards | B65H 5/062 271/226 |
| 6,170,727 | B1 * | 1/2001 | Hevenor | B41J 11/0055 226/16 |
| 6,173,952 | B1 * | 1/2001 | Richards | B65H 5/062 271/228 |
| 2004/0256795 | A1 * | 12/2004 | Sawai | B65H 5/06 271/272 |
| 2010/0301851 | A1 * | 12/2010 | Park | B24B 49/105 324/240 |
| 2013/0248332 | A1 * | 9/2013 | Nagao | B65H 5/062 198/782 |
| 2014/0232800 | A1 * | 8/2014 | Sano | B65H 29/125 347/104 |

* cited by examiner

CONVEYANCE APPARATUS AND IMAGE RECORDING APPARATUS PROVIDED WITH THE SAME

CROSS REFERENCE TO RELATED APPLICATION

The present application claims priority from Japanese Patent Application No. 2015-074344 filed on Mar. 31, 2015, the disclosure of which is incorporated herein by reference in its entirety.

BACKGROUND

Field of the Invention

The present invention relates to a conveyance apparatus configured to convey a sheet, and an image recording apparatus provided with the conveyance apparatus.

Description of the Related Art

Conventionally, there is known an image forming apparatus which is capable of moving a path member (such as a platen, a roller, etc.) defining a conveyance path for a sheet by moving a release rod so as to widen a gap (clearance) in the conveyance path. By moving the path member to thereby widen the gap in the conveyance path, a sheet jammed in the conveyance path can be easily removed.

In a case that the path member is provided as a plurality of path members arranged side by side in a width direction of the conveyance path, there can be conceived such a configuration wherein all the path members are connected to a single slide member, and the slide member is moved in linkage with a release rod to thereby move all the path members. An abutting portion, such as a cam surface, configured to guide each of the path members while abutting against each of the path members to thereby move each of the path members, is disposed in a linking portion, of the slide member, in which the slide member is linked to each of the path members. The abutting portion is provided as a plurality of abutting portions at a plurality of locations in the slide member, corresponding to the path members, respectively, with a spacing distance interposed therebetween in the width direction.

SUMMARY

There is such a fear that any variation might be generated in the moving timing at which the respective path members are moved, due to a position at which a force is applied from the release rod to the slide member during movement of the release rod, and/or due to any variation in size or dimension occurring during manufacture of the slide member, etc.

It is necessary to allow the size of the abutting portions to have a margin to some extent for the purpose of moving all the path members to a target position in an ensured manner even if there were any variation in the moving timing as described above. For example, in a case that each of the abutting portions is a cam surface, it is necessary that the length, of the cam surface, in a moving direction of the slide member is made to be longer than a minimum length, of the cam surface, required for moving each of the path members to move to the target portion. However, any design with such a margin increases the size of the slide member as a result. In addition, such a design also increases the movement amount of the release rod required for moving each of the path members to the target position.

The present teaching has been made in view of the situations as described above. An object of the present teaching is to provide a conveyance apparatus capable of assuredly realizing the reliability with respect to the timing error among a plurality of path members configured to be movable.

According to an aspect of the present teaching, there is provided a conveyance apparatus including:

a conveyance roller;

a plurality of driven rollers arranged to face the conveyance roller and arranged side by side to each other in an axial direction of the conveyance roller;

a plurality of roller holders arranged side by side to each other in the axial direction, configured to support the driven rollers to be rotatable, respectively, and configured to be movable to a first position at which the driven rollers abut against the conveyance roller and to a second position at which the driven rollers are separated from the conveyance roller;

an biasing member configured to urge each of the roller holders toward the first position; and a movable member configured to be movable to a third position and to a fourth position along an orthogonal direction orthogonal to the axial direction, the movable member having a plurality of cam portions which are disposed corresponding to the roller holders, respectively, and which are configured to abut against the roller holders respectively in a movement process during which the movable member is moved from the third position to the fourth position to thereby move the roller holders from the first position to the second position, wherein each of the cam portions has:

a first inclined surface inclined in a direction approaching toward one of the driven rollers in a moving direction of the movable member moving from the third positon toward the fourth position, and configured to abut against one of the roller holders from a side of one of the driven rollers corresponding thereto, during the movement process of the movable member from the third position to the fourth position, to thereby move one of the roller holders from the first position toward the second position; and a second inclined surface arranged upstream of the first inclined surface in the moving direction, inclined in a direction separating away from one of the driven rollers in the moving direction, and configured to abut against one of the roller holders from the side of one of the driven rollers, during the movement process of the movable member from the third position to the fourth position.

According to this configuration, when the movable member is moved from the third position toward the fourth position, the first inclined surface of each of the cam portions abuts against one of the roller holders corresponding thereto, thereby guiding the roller holder along the first inclined surface. With this, the roller holder is moved from the first position toward the second position. In this situation, the roller holder is pressed against the first inclined surface by the urging force applied by the biasing member. With this, a force (first force) in a direction for moving the roller holder toward the driven roller along the first inclined surface acts on the roller holder. In other words, a force directed from the fourth position toward the third position acts on the roller holder. Namely, the movable member is moved from the third position toward the fourth position while resisting the first force.

In this situation, there is such a fear that any variation might be generated in a timing at which the movement of the respective roller holders to the second position is completed, due to a position at which the force is applied to the movable member during the movement of the movable member, and/or due to any variation in size or dimension occurring during manufacture of the movable member, etc. In a case that, regardless of the fear that the above-described variation might occur, the length, of the first inclined surface, in the moving direction is designed to be substantially same as a minimum length, of the first inclined surface, required for moving each of the roller holders from the first position to the second position, there is such a fear that the following problem might occur. Namely, in a case that the above-described variation occurs, a certain roller holder which is included in the plurality of roller holders and which has firstly passed the first inclined surface and has already reached the second position might return to the first inclined surface by being affected by the first force acting on the movable member and applied by another roller holder which is included in the plurality of roller holders and which is still moving along the first inclined surface.

In view of the above situation, the configuration of the aspect of the present teaching provides the second inclined surface on the cam portion. The roller holder guided by the first inclined surface and is thereby moved to the second position is allowed to be separated from the first inclined surface and to abut against the second inclined surface. In this situation, the roller holder is pressed against the second inclined surface by the urging force of the biasing member. With this, a force (second force) in a direction for moving the roller holder toward the driven roller along the second inclined surface acts on the roller holder. In other words, a force in an opposite direction to the direction for returning to the first inclined surface acts on the roller holder. Since the second force acts on the roller holder which has passed the first inclined surface, any possibility that this roller holder might return to the first inclined surface can be lowered.

According to another aspect of the present teaching, there is provided an image recording apparatus including:

the conveyance apparatus of the above-described aspect of the present teaching; and a recording section configured to record an image on a sheet which is being conveyed by the conveyance roller and the plurality of driven rollers.

According to the present teaching, it is possible to assuredly realize the reliability with respect to the timing error among the plurality of roller holders which are configured to be movable.

DESCRIPTION OF THE EMBODIMENTS

Figure 1:
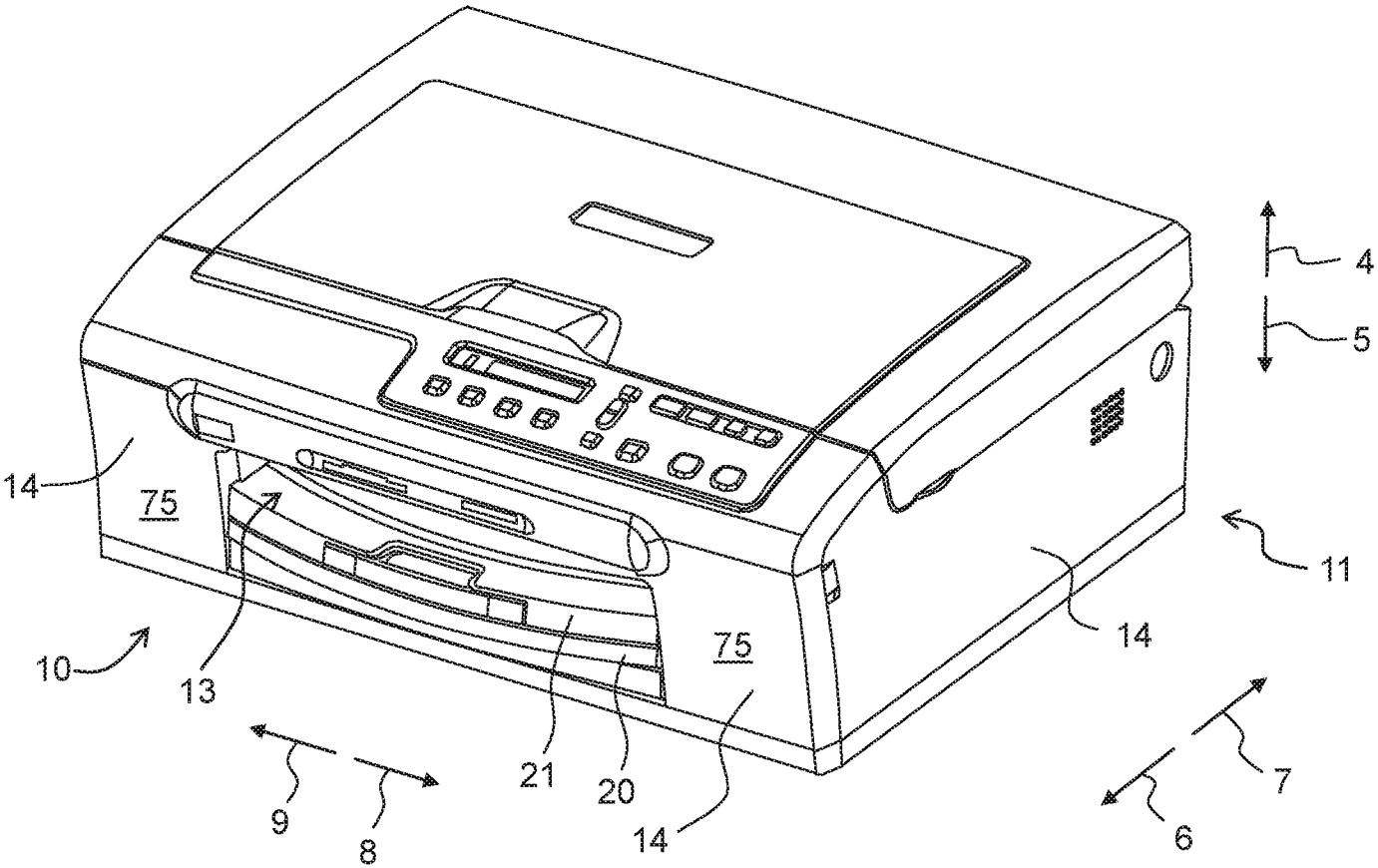
FIG. 1 is a perspective view depicting the external appearance of a multi-function peripheral 10.

In the following, an embodiment of the present teaching will be explained with reference to the drawings as appropriate. It is needless to say that the embodiment to be explained below is merely an example of the present teaching, and that it is possible to appropriately change the embodiment of the present teaching without departing from the gist and scope of the present teaching. In the following explanation, an up direction 4 and a down direction 5 are defined with a state that a multi-function peripheral 10 is usably placed (usable state; state depicted in FIG. 1), as the reference, a front direction 6 and a rear direction 7 are defined such that a surface on which an opening 13 of the multi-function peripheral 10 is provided is the frontward surface (front surface or front side), and a right direction 8 and a left direction 9 are defined as viewing the multi-function peripheral 10 from the frontward surface (front surface).

Entire Structure of Multifunction Peripheral 10

As depicted in FIG. 1, the multi-function peripheral 10 is formed to have a substantially rectangular parallelepiped shape of a thin type. A printer unit 11 (an example of an image recording apparatus) is provided in a lower portion of the multi-function peripheral 10. The multi-function peripheral 10 has various functions such as a facsimile function and a print function. As the print function, the multi-function peripheral 10 has a function of recording an image, etc., on one surface of a paper 12 (paper sheet 12; see FIG. 2) by an ink-jet recording system. Note that the multi-function peripheral 10 may be configured to record an image, etc., by a system different from the ink-jet recording system, for example, by an electro-photographic system. Further, note that the multi-function peripheral 10 may have a function of recording an image, etc., on both surfaces of the paper 12.

The printer unit 11 has a conveyance apparatus configured to convey the paper 12. The conveyance apparatus is provided with a conveyance roller pair 59 (see FIG. 2), a roller holder 85 (see FIG. 7), a coil spring 86 (see FIG. 7), a movable member 53 (see FIG. 4), a lever 54 (see FIG. 4), and a support frame 51 (see FIG. 4).

Feeding Tray 20

As depicted in FIG. 1, the printer unit 11 is provided with a casing 14 having the opening 13 formed in a front surface 75 of the casing 14. In the printer unit 11, a feeding tray 20 and a discharge tray 21 supported by the feeding tray 20 are insertable in the rear direction 7 and removable or detachable in the front direction 6, both via the opening 13.

Figure 2:
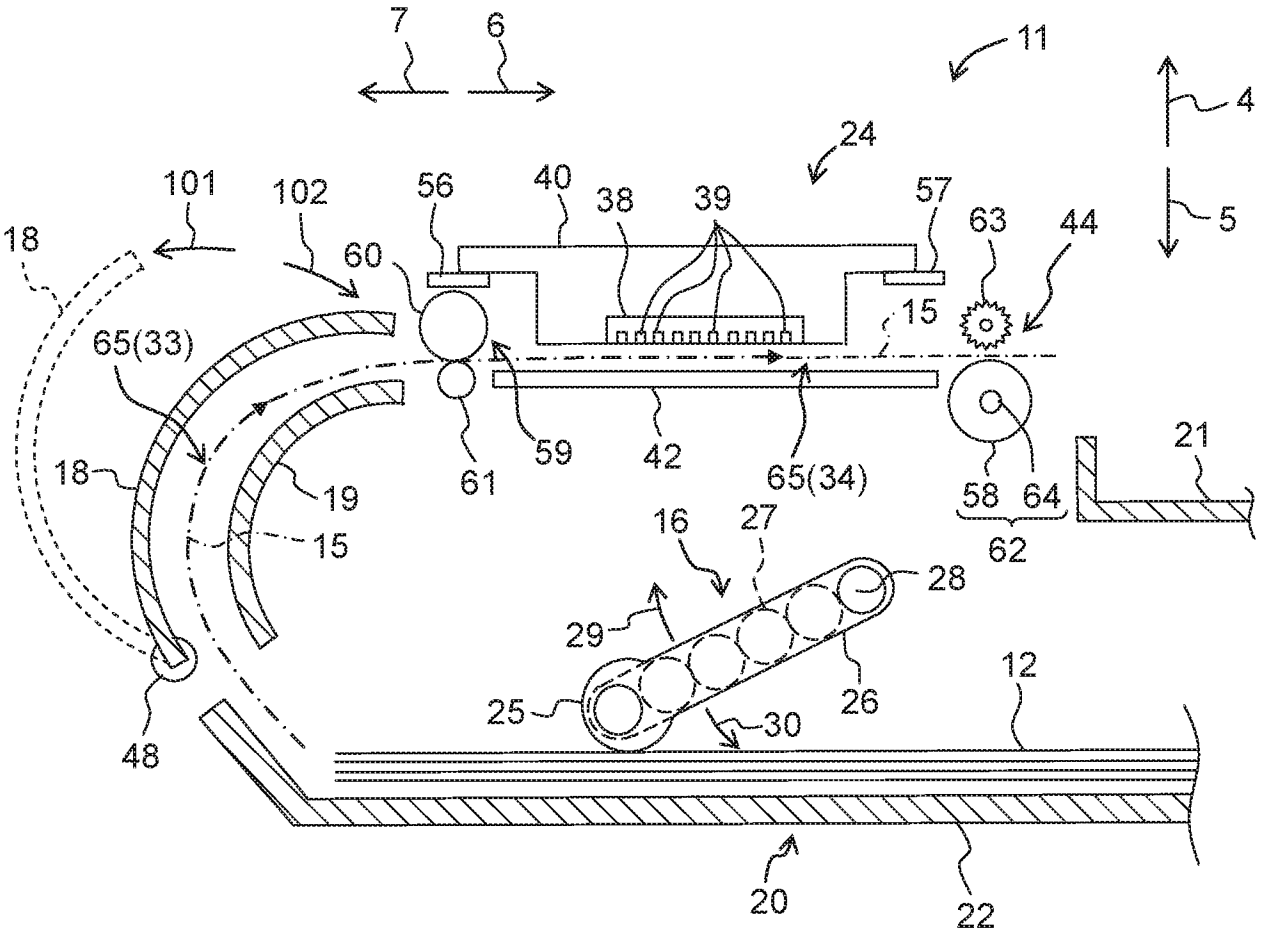
FIG. 2 is a vertical cross-sectional view schematically depicting the internal structure of a printer unit 11.
Figure 7:
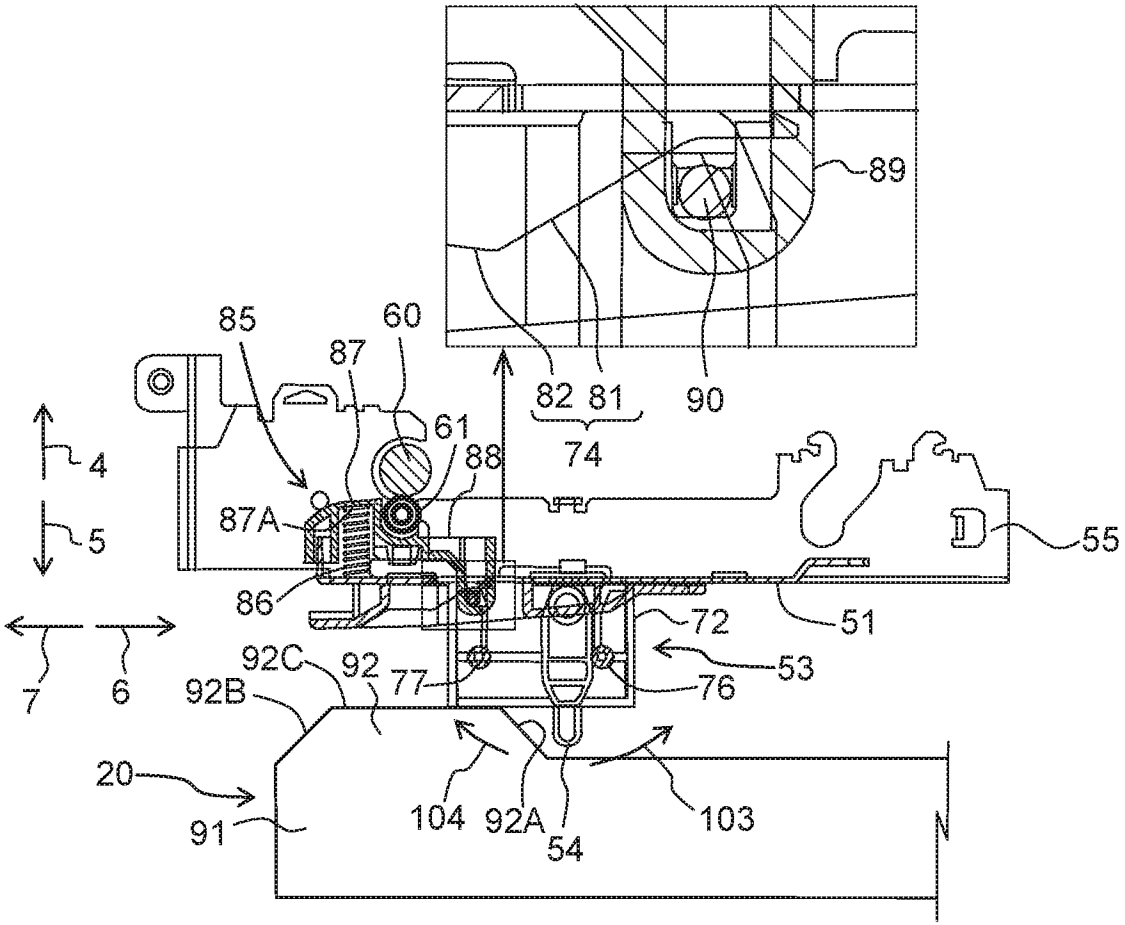
FIG. 7 is a cross-sectional view of FIG. 3 seen from a direction of a line VIIA-VIIA in FIG. 3 and depicting those in the periphery of the movable member 53, in a state that the movable member 53 is located at a third position, the roller holders 85 are located at the first position, and a lever 54 is at a central position.

As depicted in FIG. 2, a plurality of sheets of the paper 12 are supported in a stacked state by a bottom plate 22 of the feeding tray 20. The feeding tray 20 is a member having a box-like shape of which upper portion is opened. A pair of side plates 91 (see FIG. 7) projecting in the up direction 4 and extending in the front and rear directions 6 and 7 are arranged respectively at right and left end portions of the bottom plate 22. As depicted in FIG. 7, a projection 92 projecting in the up direction 4 is formed in a rear end portion of each of the pair of side plates 91.

Feeding Section 16

As depicted in FIG. 2, the feeding section 16 is disposed above the bottom plate 22 in the up direction 4. The feeding section 16 includes a feeding roller 25, a feeding arm 26, and a driving transmitting mechanism 27. The feeding roller 25 is rotatably supported by the feeding arm 26 at a front end of the feeding arm 26. The feeding arm 26 rotates (pivots) in directions indicated by arrows 29 and 30, respectively, with a shaft 28 disposed at the base end of the feeding arm 26 as the rotating center. With this, the feeding roller 25 is capable of contacting with and separating away from the feeding tray 20 or the paper 12 supported by the feeding tray 20.

The feeding roller 25 is rotated by the driving force of a conveyance motor (not depicted in the drawings) which is transmitted from the conveyance motor to the feeding roller 25 by the driving transmitting mechanism 27 constructed of a plurality of gears intermeshed with each other. With this, the feeding roller 25 makes contact with an uppermost paper 12, of the plurality of sheets of the paper 12 supported by the bottom plate 22, and feeds the uppermost paper 12 to a conveyance route 65. Note that the feeding roller 25 may rotate by receiving a driving force applied to the feeding roller 25 from a motor provided separately from the conveyance motor. Further, the driving transmitting mechanism 27 is not limited to the aspect constructed of the plurality of gears, and may be, for example, an aspect including a belt wound around the shaft 28 and around the shaft of the feeding roller 25.

Conveyance Route 65

As depicted in FIG. 2, the conveyance route 65 is extended from a rear-end portion of the feeding tray 20 in a state that the feeding tray 20 is installed in the printer unit 11. The conveyance route 65 includes a curved portion 33 and a linear portion 34. The curved portion 33 extends while curving. The linear portion 34 extends in the front direction 6 and in the rear direction 7.

The curved portion 33 is defined by a first guide member 18 and a second guide member 19 which are arranged to face with each other with a predetermined gap intervened therebetween. The linear portion 34 is defined by the recording section 24 and the platen 42, which face with each other with a predetermined gap intervened therebetween, at a position where the recording section 24 is arranged. Each of the first and second guide members 18 and 19 are provided to extend in the right direction 8 and the left direction 9 which are orthogonal to the sheet surface of FIG. 2.

The paper 12 supported by the feeding tray 20 is conveyed by the feeding roller 25 such that the paper 12 makes a U-turn from the lower portion toward the upper portion of the curved portion 33, and arrives at the conveyance roller pair 59. The paper 12 pinched between the conveyance roller pair 59 is conveyed in the linear portion 34 in the front direction 6 toward the recording section 24 in a state that an image recording surface of the sheet 12 is oriented to face the recording section 24. When the image recording surface of the paper 12 reaches a position immediately below the recording section 24, an image is recorded on the image recording surface by the recording section 24. The paper 12, on which the image has been recorded, is conveyed in the linear portion 34 in the front direction 6 and is discharged to the discharge tray 21. As described above, the paper 12 is conveyed in a conveyance direction 15 indicated by an arrow of a dashed-dotted line depicted in FIG. 2.

First Guide Member 18

The first guide member 18 is configured to be rotatable (pivotable) in directions of arrows 101 and 102 (see FIG. 2), respectively, about an axis 48 formed in a lower portion of the first guide member 18. In a state that the first guide member 18 is located at a position as depicted with solid lines in FIG. 2, the first guide member 18 defines the curved portion 33. On the other hand, in a state that the first guide member 18 is located at a positon as depicted in broken lines in FIG. 2, the curved portion 33 is exposed to the outside of the multi-function peripheral 10. A user of the multi-function peripheral 10 can remove or take out a paper 12 jammed in the conveyance route 65 by rotating the first guide member 18 and thereby exposing the curved portion 33 to the outside of the multi-function peripheral 10.

Note that it is not necessarily indispensable that the first guide member 18 is configured to be rotatable; it is allowable that the first guide member 18 is configured to be movable by a manner or system different from the rotation (pivoting). For example, the first guide member 18 may be configured to be detachably attachable with respect to the casing 14.

Recording Section 24

As depicted in FIG. 2, the recording section 24 is arranged above the linear portion 34 n the up direction 4, and is provided with a carriage 40 and a recording head 38. At a positon below the recording section 24 in the down direction 5 and facing the recording section 24, a platen 42 is arranged. The platen 42 is a member configured to support the paper 12 which is (being) conveyed in the linear portion 34.

The carriage 40 is supported by two guide rails 56 and 57 which are arranged apart from each other in the front direction 6 and the rear direction 7 such that the carriage 40 can reciprocate in the right direction 8 and the left direction 9. The recording head 38 is mounted on the carriage 40. An ink is supplied to the recording head 38 from an ink cartridge (not depicted in the drawings). A surface, of the recording head 38, oriented to face the down direction 5 is formed with nozzles 39. In a state that the carriage 40 is moving, the recording head 38 discharges ink droplets of the ink from the nozzles 39 toward the platen 42. With this, an image, etc., is recorded on the paper 12 conveyed by the conveyance roller pair 59 and supported by the platen 42.

Support Frame 51 and Side Frames 55

Figure 3:
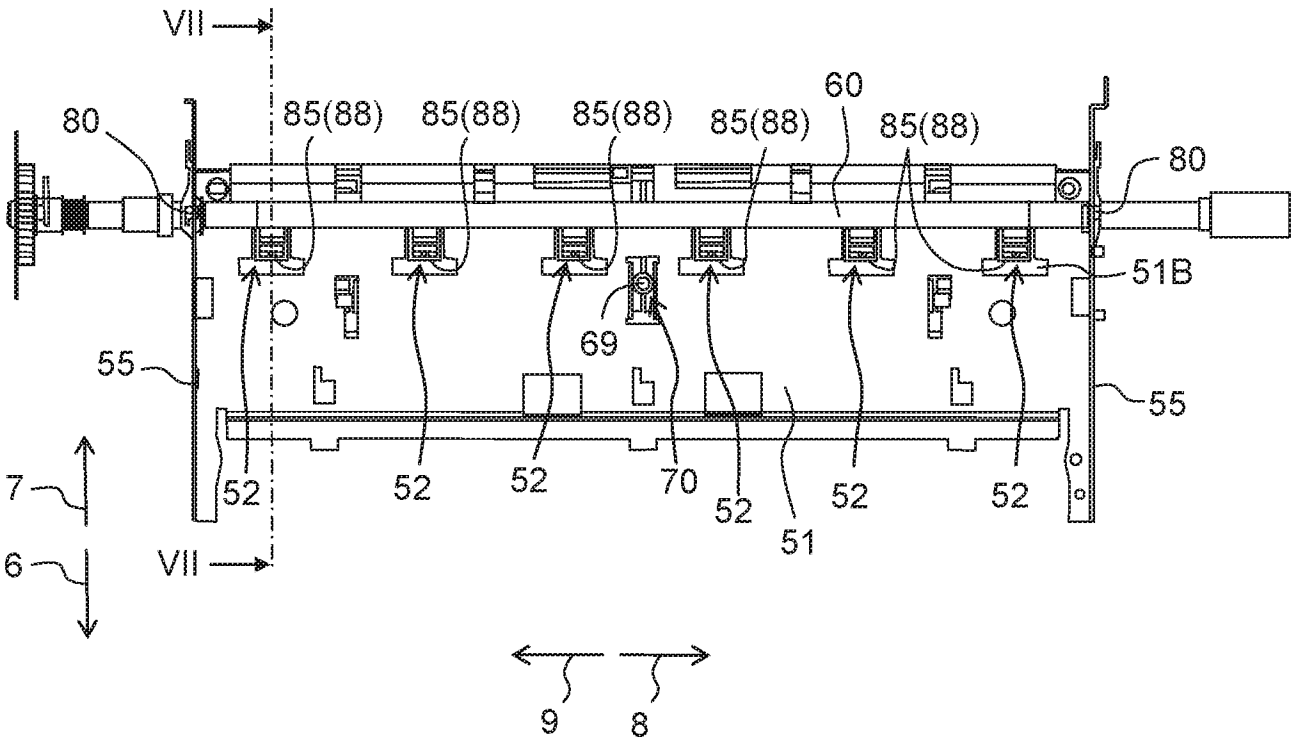
FIG. 3 is a plan view of a support frame 51, side frames 55, a conveyance roller 60 and roller holders 85.
Figure 4:
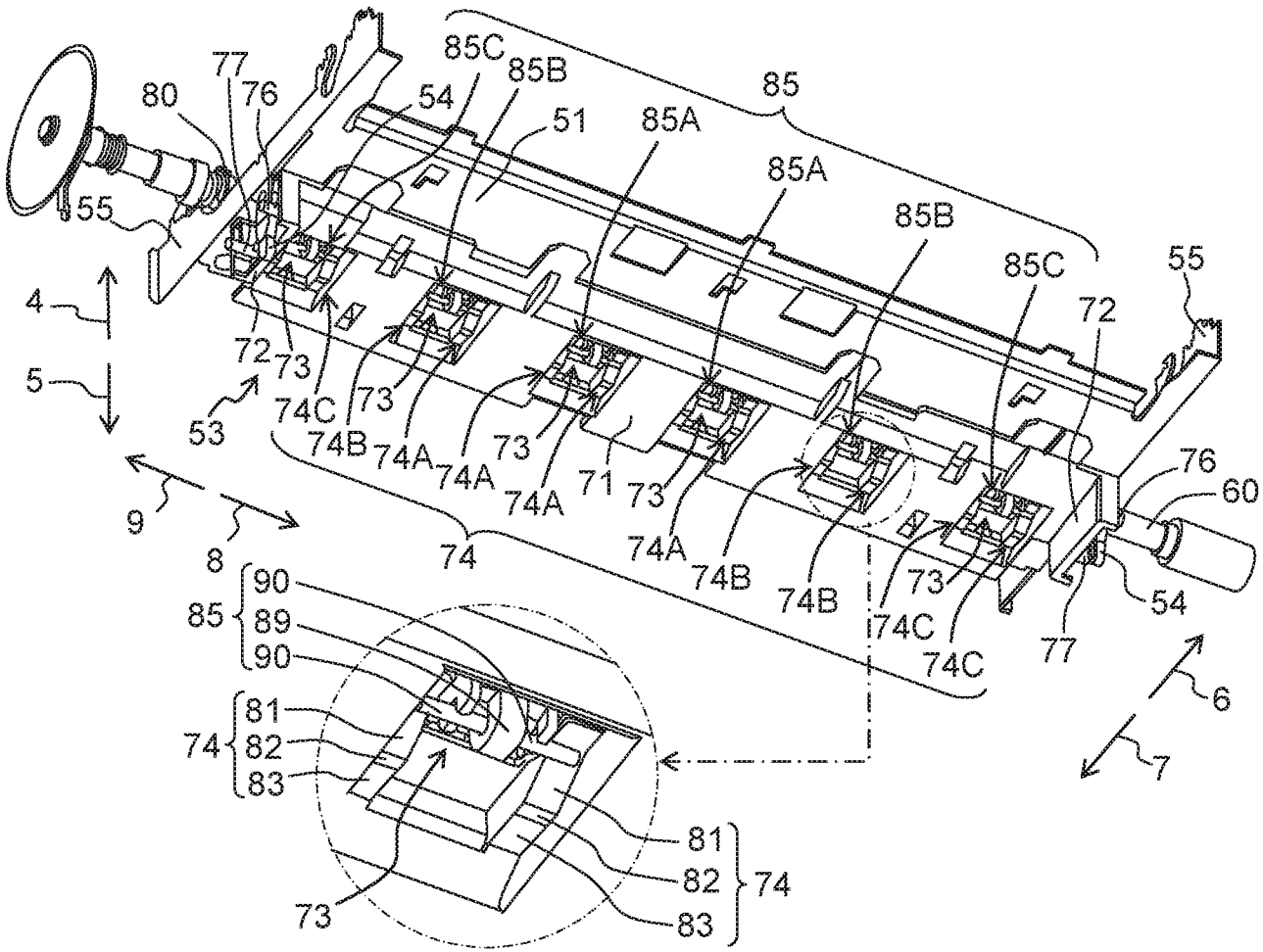
FIG. 4 is a perspective view of a movable member 53, the support frame 51, the side frames 55, the conveyance roller 60, and the roller holders 85 at a first position, as seen from below.
Figure 5:
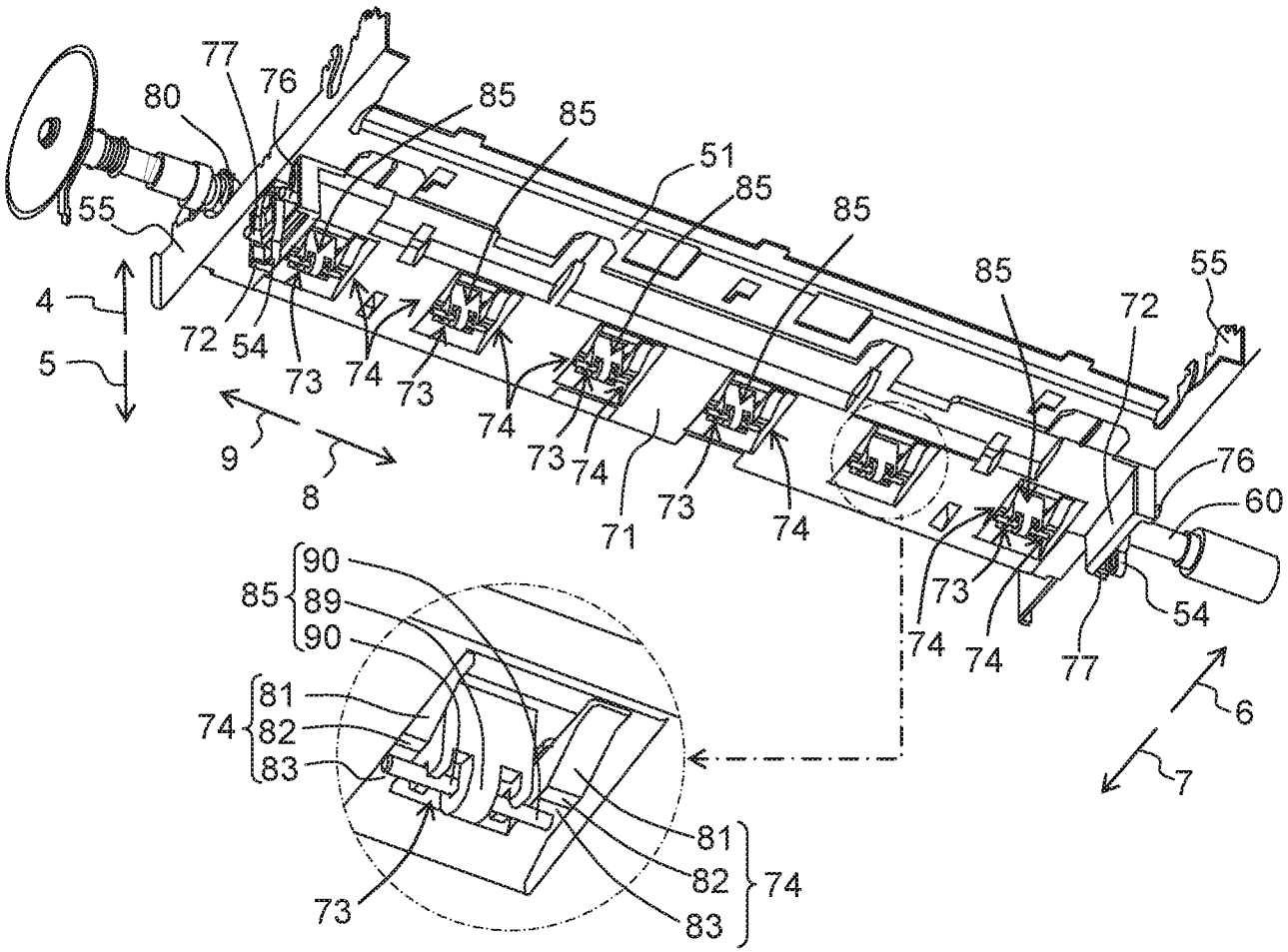
FIG. 5 is a perspective view of the movable member 53, the support frame 51, the side frames 55, the conveyance roller 60, and the roller holders 85 at a second position, as seen from below.

The support frame 51 as depicted in FIGS. 3 to 5 is arranged at a location below the platen 42 in the down direction 5. As depicted in FIGS. 3 to 5, the support frame 51 is a plate-shaped member which is made of metal and which is extended or elongated in the front direction 6 and rear direction 7, and in the right direction 8 and left direction 9.

A plurality of openings 52 are formed in the support frame 51 with a spacing distance therebetween in the right direction 8 and left direction 9. Each of the openings 52 is formed at a position corresponding to one of roller holders 85 (to be described later on).

A long hole 70 (see FIG. 3) elongated in the front direction 6 and rear direction 7 is formed in the support frame 51 at a central portion thereof in the right direction 8 and left direction 9.

A pair of side frames 55 projecting in the up direction 4 and extending in the front direction 6 and rear direction 7 are provided on right and left end portions, respectively, of the support frame 51. The pair of side frames 55 are arranged respectively at locations shifted in the right direction 8 and left direction 9 with respect to the linear portion 34. The pair of side frames 55 are made of metal. In the embodiment, the pair of side frames 55 are integrally formed with the support frame 51.

Conveyance Roller Pair 59 and Discharge Roller Pair 44

As depicted in FIG. 2, the conveyance roller pair 59 is arranged in the linear portion 34 at a location upstream in the conveyance direction 15 of the recording head 38. A discharge roller pair 44 is arranged in the linear portion 34 at a location downstream in the conveyance direction 15 of the recording head 38.

The conveyance roller pair 59 includes a conveyance roller 60 which is arranged above the linear portion 34 in the up direction 4 and a pinch roller 61 (an example of a driven roller) which is arranged below the linear portion 34 in the down direction 5 to face the conveyance roller 60.

As depicted in FIGS. 3 to 5, the conveyance roller 60 is a cylindrical-shaped member rotating with the right direction 8 and left direction 9 as the axial direction. The conveyance roller 60 is supported by the pair of side frames 55 at both left and right end portions thereof, via a bearing 80, so that the conveyance roller 60 is rotatable.

Figure 6:
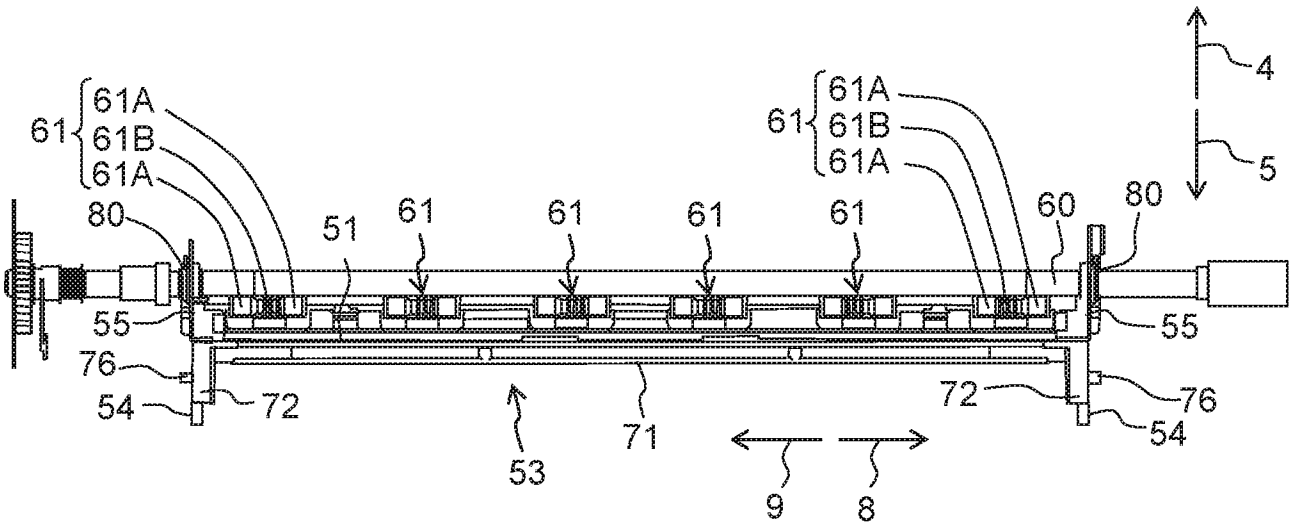
FIG. 6 is a front view of the movable member 53, the support frame 51, the side frames 55, the conveyance roller 60, and the roller holders 85 at the first position.

As depicted in FIG. 6, the pinch roller 61 is a cylindrical-shaped member rotating with the right direction 8 and left direction 9 as the axial direction. The pinch roller 61 is provided as six pieces of pinch roller 61 arranged at a spacing distance therebetween in the right direction 8 and left direction 9. Each of the pinch rollers 61 is constructed of a pair of roller portions 61A which are arranged at a spacing distance in the right direction 8 and left direction 9 and which are abuttable against a roller surface of the conveyance roller 60, and a connecting portion 61B connecting the pair of roller portions 61A with each other. Each of the pinch rollers 61 is supported to be rotatable by the roller holder 85 (to be described later on). Note that it is not necessarily indispensable that the number of the pinch roller 61 is six; it is allowable that the number of the pinch roller 61 may be appropriately changed. Further, the configuration of each of the pinch rollers 61 is not limited to the above-described configuration. For example, each of the pinch rollers 61 may be constructed only of one piece of the roller portion 61A.

As depicted in FIG. 2, the discharge roller pair 44 includes a discharge roller 62 arranged to be below the linear portion 34 in the down direction 5, and a spur roller 63 arranged to be above the linear portion 34 in the up direction 4 and to face the discharge roller 62. The spur roller 63 is provided as a plurality of spur rollers 63 arranged at a spacing distance therebetween in the right direction 8 and left direction 9. The discharge roller 62 is provided with a shaft 64 extending in the right direction 8 and left direction 9, and a roller section 58 attached to the shaft 64. The roller section 58 is provided as a plurality of roller sections 58 and arranged at a spacing distance therebetween in the right direction 8 and left direction 9 at positions facing the spur rollers 63, respectively. Each of the spur rollers 63 is pressed against one of the roller sections 58 corresponding thereto by an unillustrated elastic member.

The conveyance roller 60 and the discharge roller 62 are rotated by a driving force transmitted from the conveyance motor to the conveyance roller 60 and the discharge roller 62. When the conveyance roller 60 is rotated in a state that the sheet 12 is pinched by the conveyance roller pair 59, the sheet 12 is conveyed in the conveyance direction 15 by the conveyance roller pair 59. On the other hand, when the discharge roller 62 is rotated in a state that the sheet 12 is pinched by the discharge roller pair 44, the sheet 12 is conveyed in the conveyance direction 15 by the discharge roller pair 44.

Roller Holder 85 and Coil Spring 86

The pinch rollers 61 are rotatably supported respectively by the roller holders 85 depicted in FIG. 7. The roller holders 85 are supported by the support frame 51 as will be described later on.

The roller holders 85 are provided corresponding to the respective pinch rollers 61. Namely, the roller holder 85 is provided as six roller holders 85 such that the six roller holders 85 are arranged at a spacing distance therebetween in the right direction 8 and left direction 9. It goes without saying that the number of the roller holders 85 may be other than six pieces, depending on the number of the pinch rollers 61. Alternatively, it is allowable that the roller holders 85 are provided not corresponding to the respective pinch rollers 61. For example, such a configuration is allowable wherein three pieces of the roller holder 85 are provided with respect to six pieces of the pinch roller 61, and each of the roller holders 85 supports two pieces of the pinch roller 61.

As depicted in FIG. 7, each of the roller holders 85 supports one of the pinch rollers 61 to be rotatable at a substantially central portion, of the roller holder 85, in the front direction 6 and rear direction 7. Each of the roller holders 85 is provided with a rearward extending portion 87 extending from the central portion in the rear direction 7, a frontward extending portion 88 extending from the central portion in the front direction 6, a downward extending portion 89 extending from a front end portion of the frontward extending portion 88 in the down direction 5, and abutting portions 90 extending from a lower end portion of the downward extending portion 89 respectively in the right direction 8 and the left direction 9 and capable of abutting against the movable member 53 (to be described later on).

An end portion of a coil spring 86 (an example of an biasing member) is connected to a surface 87A, of the rearward extending portion 87, facing or oriented in the down direction 5. The other end portion of the coil spring 86 is connected to a surface, of the support frame 51, oriented in the up direction 4. With this, each of the roller holders 85 is supported by the support frame 51 via the coil spring 86. Namely, the support frame 51 supports the roller holders 85 and the coil springs 86.

The downward extending portion 89 is inserted through the opening 52 formed in the support frame 51 and through an opening 73 formed in the movable member 53 (to be described later on).

Figure 8:
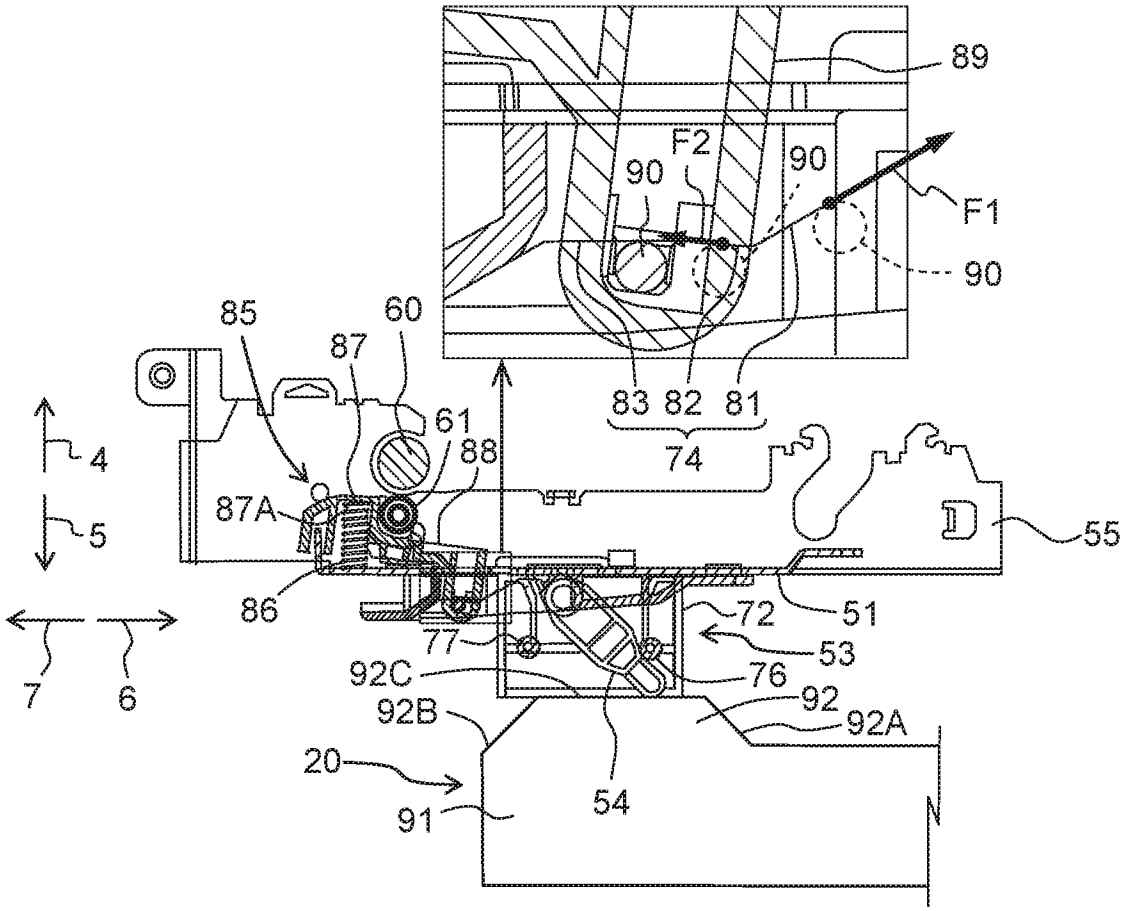
FIG. 8 is a cross-sectional view of FIG. 3 seen from the direction of the line VIIIA-VIIIA in FIG. 3 and depicting those in the periphery of the movable member 53, in a state that the movable member 53 is located at a fourth position, the roller holders 85 are located at the second position, and the lever 54 is at a forward inclined position.

Each of the roller holders 85 is movable between a first portion as depicted in FIG. 7 and a second position as depicted in FIG. 8, by the expansion and compression of the coil spring 86.

When the roller holder 85 is located at the first position, the pinch roller 61 is a state that the pinch roller 61 abuts against or contacts the conveyance roller 86 and that the coil spring 86 is in a state that the coil spring 86 is shorter than the natural length thereof. Namely, the pinch roller 61 is in a state of being pressed against the conveyance roller 60.

When the roller holder 85 is located at the second position, the roller holder 85 is located at a position below in the down direction 5 than in the case that the roller holder 85 is located at the first position. Under the condition that the roller holder 85 is located at the second position, the pinch roller 61 is in a state of being separated away from the conveyance roller 60. In this situation, the coil spring 86 is in a more compressed state than in the situation wherein the roller holder 85 is located at the first position. Namely, the coil spring 86 urges the roller holder 85 toward the first position.

Movable Member 53

As depicted in FIGS. 4, 5 and 7 to 10, the movable member 53 is arranged to be below the support frame 51 in the down direction 5.

The movable member 53 is supported to be movable in the front direction 6 and the rear direction 7 by an unillustrated frame. The movable member 53 is supported by the unillustrated frame in a state that the movable member 53 is brought into contact with a lower surface 51A of the support frame 51 from therebelow. Further, the movable member 53 maintains the state that the movable member 53 abuts against the lower surface 51A during the movement of the movable member 53. Namely, the movable member 53 is capable of moving while slidably contacting with the support frame 51.

As depicted in FIG. 3, a central portion, of the upper surface of the movable member 53, in the right direction 8 and left direction 9, is formed with a projection 69 projecting in the up direction 4. The projection 69 is inserted into the long hole 70 formed in the support frame 51. The length, of the projection 69, in the right direction 8 and left direction 9 is substantially same as the length, of the long hole 70, in the short direction (right direction 8 and left direction 9). Further, the length of the long hole 70 in the longitudinal direction (front direction 6 and rear direction 7) is longer than the length of the projection 69 in the front direction 6 and the rear direction 7. With this, the projection 69 is movable in the front direction 6 and rear direction 7 along the long hole 70 in a state that the projection 69 is positioned in the right direction 8 and left direction 9. Namely, the movable member 53 is movable in the front direction 6 and rear direction 7 in the state that the movable member 53 is positioned with respect to the right direction 8 and left direction 9.

As depicted in FIGS. 4 and 5, the movable member 53 is provided with a body portion 71 and a pair of side walls 72. The length, of the body portion 71, in the right direction 8 and left direction 9 and the length, of the body portion 71, in the front direction 6 and rear direction 7 are longer than the length thereof in the up direction 4 and down direction 5. The pair of side walls 72 project in the down direction 5 from right and left end portions, respectively, of the body portion 71.

The body portion 71 is formed with a plurality of openings 73 at a spacing distance therebetween in the right direction 8 and left direction 9. The openings 73 are formed in positions in the right direction 8 and left direction 9 so as to correspond respectively to the openings 52 formed in the support frame 51. The openings 52 and the openings 73 are overlapped with one another with the openings 52 arranged at positions above the openings 73 and with the openings 73 arranged at positions below the openings 52. In this situation, the length of the openings 73 in the front direction 6 and rear direction 7 is longer than the length of the openings 52 in the front direction 6 and rear direction 7. With this, even if the movable member 53 is located at any positions in the front and rear direction 6 and 7, the openings 52 overlap with the openings 73, respectively. As a result, the downward extending portion 89 of each of the roller holders 85 is maintained in a state of being inserted through one of the openings 52 and one of the openings 73 corresponding thereto, regardless of the position of the movable member 53.

A surface, of the movable member 53, which faces in the down direction 5 is formed with a plurality of cam portions 74. The plurality of cam portions 74 is formed such that two cam portions 74, among the plurality of cam portions 74, are formed to be adjacent to one of the openings 73 while being located respectively at both sides, of one of the openings 73, in the right direction 8 and left direction 9. In other words, each of the openings 73 is sandwiched by two cam portions 74 in the right direction 8 and left direction 9, respectively. Namely, the plurality of cam portions 74 are provided such that two cam portions 74 are formed per each of the openings 73. In other words, the plurality of cam portions 74 are provided corresponding to the roller holder 85 in such a manner that two cam portions 74 among the plurality of cam portions 74 are provided per each of the roller holders 85. Note that the number of the cam portion 74 is not limited to two pieces per each of the roller holders 85. For example, one piece of the cam portion 74 may be provided corresponding to each of the roller holders 85.

Each of the cam portions 74 is a surface oriented in the down direction 5 and extending in the front direction 6 and rear direction 7. An abutting portion 90, among the abutting portions 90, which projects in the right direction 8 from the downward extending portion 89, of the roller holder 85, inserted through the opening 73 abuts against a cam portion 74, among the cam portions 74, which is formed on the right side of the opening 73 in the right direction 8, from a position below the cam portion 74. On the other hand, another abutting portion 90, among the abutting portions 90, which projects in the left direction 9 from the downward extending portion 89, of the roller holder 85, inserted through the opening 73 abuts against a cam portion 74, among the cam portions 74, which is formed on the left side of the opening 73 in the left direction 9, from a position below the cam portion 74.

Each of the cam portions 74 is provided with a first inclined surface 81, a second inclined surface 82 and a horizontal surface 83.

The first inclined surface 81 is a surface inclined in the front direction 6 and in the up direction 4. In other words, the first inclined surface 81 is a surface inclined in a direction approaching toward the pinch roller 61 in the front direction 6.

The second inclined surface 82 is arranged on the rear side of the first inclined surface 81 in the rear direction 7, and is a surface continued to the rear end portion of the first inclined surface 81. The second inclined surface 82 is a surface inclined in the front direction 6 and in the down direction 5. In other words, the second inclined surface 82 is a surface inclined in a direction separating away from the pinch roller 61 in the front direction 6. The length of the second inclined surface in the front direction 6 and rear direction 7 is shorter than the length of the first inclined surface 81 in the front direction 6 and rear direction 7. Further, the inclination angle of the second inclined surface 82 with respect to the front direction 6 and rear direction 7 is smaller than the inclination angle of the first inclined surface 81 in the front direction 6 and rear direction 7.

The horizontal surface 83 is a surface continued to the rear end portion of the second inclined surface 82. The horizontal surface 83 extends in the front direction 6 and rear direction 7.

In this embodiment, the positions of the front and rear end portions of the respective first inclined surfaces 81, and the inclination angles of the respective first inclined surfaces 81 with respect to the front direction 6 and rear direction 7 are same among the first inclined surfaces 81. Further, the positions of the front and rear end portions of the respective second inclined surfaces 82, and the inclination angles of the respective second inclined surfaces 82 with respect to the front direction 6 and rear direction 7 are same among the second inclined surfaces 82. Furthermore, the positions of the front and rear end portions of the respective horizontal surfaces 83 are same among the horizontal surfaces 83.

Two projections 76 and 77 are formed in each of the pair of side walls 72. The projections 76 and 77 project in the right direction 8 from a right side wall 72 among the pair of side walls 72, and the projections 76 and 77 project in the left direction 9 from a left side wall 72 among the pair of side walls 72. The projections 76 and 77 are formed with a spacing distance intervened therebetween in the front and rear directions 6 and 7. The projection 76 is formed on the front side of the projection 77 in the front direction 6.

The movable member 53 is movable to a third position as depicted in FIGS. 4 and 7 and to a fourth position as depicted in FIGS. 5 and 8, along the front direction 6 and rear direction 7 (direction orthogonal to the right and left directions 8 and 9 as the axial direction of the conveyance roller 60) under a condition that a lever 54 (to be described later on) abuts against the projections 76 and 77 of the movable member 53. The third position is located on the rear side of the fourth position in the rear direction 7.

As depicted in FIG. 7, when the movable member 53 is located at the third position, each of the cam portions 74 is located on the rear side of the abutting portion 90, of one of the roller holders 85, in the rear direction 7, and is separated from the abutting portion 90. With this, each of the roller holders 85 is moved in the up direction 4 by the urging force of the coil spring 86. As a result, the roller holders 85 are located at the first position, and the pinch rollers 61 abut against the conveyance roller 60.

As depicted in FIG. 8, when the movable member 53 is located at the fourth position, the second inclined surface 82 or the horizontal surface 83 (the horizontal surface 83 in FIG. 8) of each of the cam portions 74 abuts against the abutting portion 90, of one of the roller holders 85, from a position above the abutting portion 90. With this, each of the abutting portions 90 is moved in the down direction 5 by being pressed or pushed by the second inclined surface 82 or the horizontal surface 83, thereby causing each of the roller holders 85 to move in the down direction 5 resisting against the urging force of the coil spring 86. As a result, the roller holders 85 are located at the second position, and the pinch rollers 61 are separated (away) from the conveyance roller 60.

Lever 54

As depicted in FIGS. 4 and 5, levers 54 (an example of the applying member) are provided on the pair of side walls 72, of the movable member 53, at locations respectively on the right side and the left side of the pair of side walls 72 in the right direction 8 and left direction 9. Each of the levers 54 is located between the projections 76 and 77 in the front direction 6 and rear direction 7. Each of the levers 54 is located at a same position relative to the projections 76 and 77 in the right direction 8 and left direction 9. Each of the levers 54 is disposed to extend in the up direction 4 and down direction 5 and the upper end portion of the lever 54 is located on the upper side of the projections 76 and 77 in the up direction 4 and the lower end portion of the lever 54 is located on the lower side of the projections 76 and 77 in the down direction 5.

Figure 9:
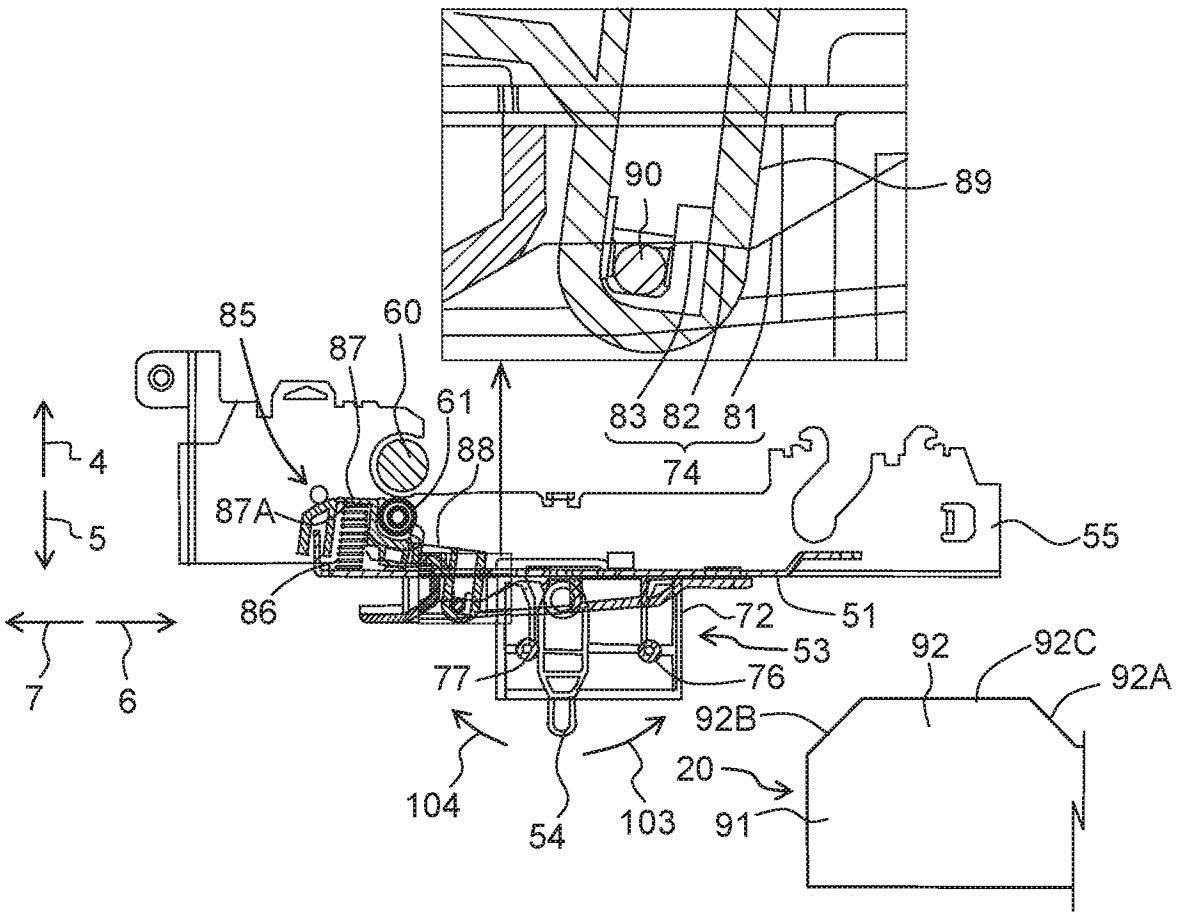
FIG. 9 is a cross-sectional view of FIG. 3 seen from a direction of a line IXA-IXA in FIG. 3 and depicting those in the periphery of the movable member 53, in a state that the movable member 53 is located at the fourth position, the roller holders 85 are located at the second position, and the lever 54 is at the central position.
Figure 10:
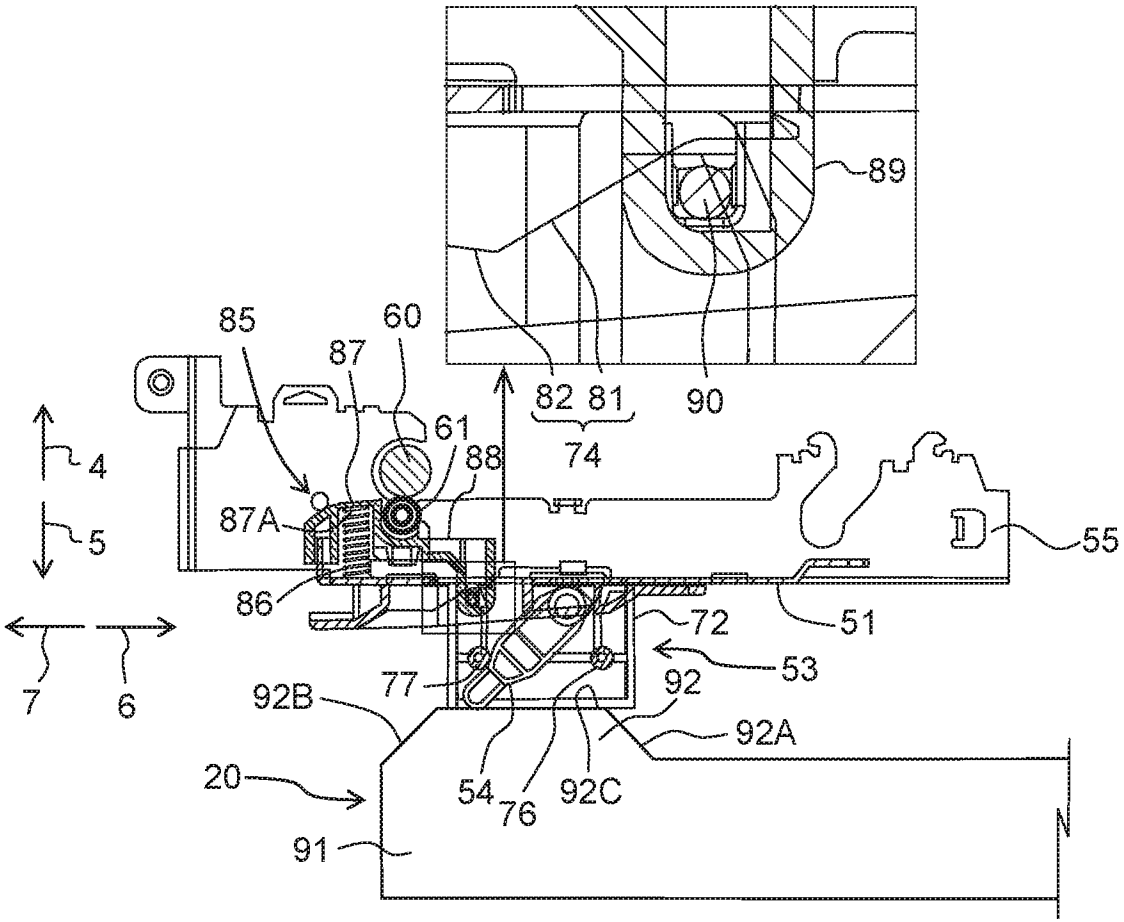
FIG. 10 is a cross-sectional view of FIG. 3 seen from a direction of a line XA-XA in FIG. 3 and depicting those in the periphery of the movable member 53, in a state that the movable member 53 is located at the third position, the roller holders 85 are located at the first position, and the lever 54 is at the rearward inclined position.

The upper end portion of each of the levers 54 is supported to be rotatable by the unillustrated frame. With this, the levers 54 are rotatable in directions indicated by arrows 103 and 104 (see FIG. 7), with the upper end portion thereof as the rotational center. Specifically, the levers 54 are rotatable to a central position as depicted in FIGS. 7 and 9, a frontward inclined position as depicted in FIG. 8, and a rearward inclined position as depicted in FIG. 10. In a process during which each of the levers 54 is rotated from the central position to the frontward inclined position, each of the levers 54 abuts against the projection 76 from the rear side thereof, and pushes the projection 76. With this, the movable member 53 is moved in the front direction 6. Further, in a process during which each of the levers 54 is rotated from the central position to the rearward inclined position, each of the levers 54 abuts against the projection 77 from the front side thereof, and pushes the projection 77. With this, the movable member 53 is moved in the rear direction 7.

As described above, the levers 54 are capable of abutting against the projections 76 and 77 provided on each of the right and left end portions of the movable member 53, and capable of imparting forces in the front and rear directions 6 and 7 to the projections 76 and 77, respectively.

An unillustrated torsion spring is attached to the upper end portion of each of the levers 54. With this, the levers 54 are urged toward the central position. Namely, in a state that any force is not externally applied to the levers 54, each of the levers 54 is positioned at the central position by the urging force of the torsion spring. On the other hand, in order that the levers 54 are rotated to the frontward inclined position and the rearward inclined position, the levers 54 need to rotate resisting against the urging force of the torsion spring.

The lower end portion of the lever 54 is capable of abutting against the projection 92 of the feeding tray 20. In a state that the feeding tray 20 is installed in the casing 14, the projection 92 is located on the rear side of the levers 54 in the rear direction 7 (see FIG. 7). When the feeding tray 20 is moved in the front direction 6 from this state, an inclined surface 92A formed at the front end portion of the projection 92 abuts against the levers 54 from the rear side of the levers 54. Here, the inclined surface 92A is a surface inclined in the front direction 6 and the down direction 5. Consequently, the levers 54 are guided by the inclined surface 92A which is moving in the front direction 6, thereby being allowed to rotate from the central position to the frontward inclined position, resisting against the urging force of the torsion spring.

The rear end portion of the inclined surface 92A is continued to a horizontal surface 92C. Thus, when the feeding tray 20 is moved in the front direction 6 and the inclined surface 92A is located on the front side of the lever 54 in the front direction 6, there is provided such a state that the lever 54 is supported by the horizontal surface 92C. With this, the lever 54 is maintained at the forward inclined position (see FIG. 8).

When the feeding tray 20 is further moved in the front direction 6 from the state depicted in FIG. 8 and causes the projection 92 to be located on the front side of the lever 54 in the front direction 6, the lever 54 is rotated from the forward inclined position to the central position by the urging force of the torsion spring (see FIG. 9).

When the feeding tray 20 which has been removed from the casing 14 is inserted back into the casing 14 in the rear direction 7, an inclined surface 92B formed in the rear end portion of the projection 92 abuts against the lever 54 from the front side of the lever 54. Here, the inclined surface 92B is a surface inclined in the rear direction 7 and in the down direction 5. Consequently, the lever 54 is guided by the inclined surface 92B which is moving in the rear direction 7, thereby being allowed to rotate from the central position to the rearward inclined position, resisting against the urging force of the torsion spring.

The forward end portion of the inclined surface 92B is continued to the horizontal surface 92C. Thus, when the feeding tray 20 is moved in the rear direction 7 and the inclined surface 92B is located on the rear side of the lever 54 in the rear direction 7, there is provided such a state that the lever 54 is consequently supported by the horizontal surface 92C. With this, the lever 54 is maintained at the rearward inclined position (see FIG. 10).

When the feeding tray 20 is further moved in the rear direction 7 from the state depicted in FIG. 10 and causes the projection 92 to be located on the rear side of the lever 54 in the rear direction 7, the lever 54 is rotated from the rearward inclined position to the central position by the urging force of the torsion spring (see FIG. 7).

Movement of Movable Member 53

In the following, an explanation will be given about the movement of the roller holders 85 accompanying with the movement of the movable member 53. As depicted in FIGS. 4 and 7, in the state that the feeding tray 20 is installed in the casing 14, the movable member 53 is located at the third position; and each of the levers 54 is located at the central position. Each of the levers 54 located at the central position abuts against the projection 76, of the movable member 53 located at the third position, from the rear side of the projection 76. Note that it is allowable that each of the levers 54 is in the vicinity of (is located closely to) the projection 76, and it is not necessarily indispensable that each of the levers 54 abuts against the projection 76. Each of the cam portions 74, of the movable member 53 which is located at the third position, is located on the rear side of the abutment portion 90, of one of the roller holders 85, in the rear direction 7, and each of the cam portions 74 is separated from the abutment portion 90. With this, each of the roller holders 85 is located at the first position by the urging force of the coil spring 86. In this situation, each of the pinch rollers 61 abuts against the conveyance roller 60.

In the state depicted in FIGS. 4 and 7, when the feeding tray 20 is moved in the front direction 6 for being removed from the casing 14, the inclined surface 92A abuts against each of the levers 54 from the rear side of the lever 54. With this, each of the levers 54 is consequently guided by the inclined surface 92A which is moving in the front direction 6, thereby being allowed to rotate from the central position to the forward inclined position, resisting against the urging force of the torsion spring (see FIG. 8).

During the process that the lever 54 is rotated from the central position to the forward inclined position, the lever 54 pushes or presses the projection 76. With this, the movable member 53 is moved in the front direction 6 (an example of the moving direction) from the third position toward the fourth position. This causes the first inclined surface 81 of the cam portion 74 to abut against the abutment portion 90 from the rear direction 7 and the up direction 4. Namely, the first inclined surface 81 abuts against the abutment portion 90 from the side of the pinch roller 61. With this, the abutment portion 90 is guided toward the second inclined surface 82 along the first inclined surface 81. As a result, the roller holder 85 is moved in the down direction 5 resisting against the urging force of the coil spring 86. Namely, the roller holder 85 is moved from the first position toward the second position.

When the first inclined surface 81 is located on the front side of the abutment portion 90 in the front direction 6, the abutment portion 90 abuts against the second inclined surface 82 and is guided along the second inclined surface 82. In this situation, the roller holder 85 has reached the second position, and the pinch roller 61 is separated from the conveyance roller 60 (see FIG. 8). The second inclined surface 82 abuts against the abutment portion 90 from the front direction 6 and in the up direction 4 (from the side of the pinch roller 61). In a process during which the abutment portion 90 is guided along the second inclined surface 82, the roller holder 85 is moved only by a small extent (amount) in the up direction 4 by the urging force of the coil spring 86. When the second inclined surface 82 is located on the front side of the abutment portion 90 in the front direction 6, the abutment portion 90 abuts against the horizontal surface 83.

In the state that the abutment portion 90 abuts against the horizontal surface 83, the lever 54 has reached the forward inclined position. Further, the movable member 53 has reached the fourth position. Furthermore, the roller holder 85 has already reached the second position as described above (see FIG. 8).

When the feeding tray 20 is further moved in the front direction 6 in the state depicted in FIG. 8 and the projection 92 is located on the front side of the lower end portion of the lever 54 in the front direction 6, the lever 54 is rotated from the forward inclined position to the central position, by the urging force of the torsion spring (see FIG. 9). In this situation, the lever 54 abuts against the projection 77 of the movable member 53 located at the fourth position from the front side of the projection 77. Note that it is allowable that the lever 54 is in the vicinity of (is located closely to) the projection 77, and it is not necessarily indispensable that the lever 54 abuts against the projection 77.

When the feeding tray 20 which has been taken out (removed) from the casing 14 is moved in the rear direction 7, in the state depicted in FIG. 9, in order that the feeding tray 20 is inserted back into the casing 14, the inclined surface 92B abuts against the lever 54 from the front side of the lever 54. With this, the lever 54 is consequently guided by the inclined surface 92B which is moving in the rear direction 7, thereby being allowed to rotate from the central position to the rearward inclined position, resisting against the urging force of the torsion spring (see FIG. 10).

During the process that the lever 54 is rotated from the central position to the rearward inclined position, the lever 54 pushes or presses the projection 77. With this, the movable member 53 is moved in the rear direction 7 from the fourth position toward the third position. This causes the second inclined surface 82 of the cam portion 74 to abut against the abutment portion 90 from the front side of the abutment portion 90. With this, the abutment portion 90 is guided toward the first inclined surface 81 along the second inclined surface 82. As a result, the roller holder 85 is moved only by a small amount in the down direction 5, resisting against the urging force of the coil spring 86.

When the second inclined surface 82 is located on the rear side of the abutment portion 90 in the rear direction 7, the abutment portion 90 abuts against the first inclined surface 81 and is guided along the first inclined surface 81. In a process during which the abutment portion 90 is guided along the first inclined surface 81, the roller holder 85 is moved in the up direction 4 by the urging force of the coil spring 86. In the state that the first inclined surface 81 is located on the rear side of the abutment portion 90 in the rear direction 7 and is separated from the abutment portion 90, the lever portion 54 has reached the rearward inclined position. Further, the movable member 53 has reached the third position. Furthermore, the roller holder 85 has reached the first position, and the pinch roller 61 abuts against the conveyance roller 60 (see FIG. 10).

When the feeding tray 20 is further moved in the rear direction 7 in the state depicted in FIG. 10 and the projection 92 is located on the rear side of the lower end portion, of the lever 54, in the rear direction 7, the lever 54 is rotated from the rearward inclined position to the central position by the urging force of the torsion spring (see FIG. 7).

According to the embodiment, under the condition that the movable member 53 is moved from the third position toward the fourth position, the first inclined surface 81 abuts against the abutment portion 90 of each of the roller holders 85 and the abutment portion 90 is guided along the first inclined surface 81. With this, the roller holder 85 is moved from the first position toward the second position. In this situation, the abutment portion 90 is pressed against the first inclined surface 81 by the urging force of the coil spring 86. With this, a force F1 (see FIG. 8) along the first inclined surface 81 acts on the roller holder 85. Namely, the force in the front direction 6 acts on the movable member 53. In other words, the movable member 53 is moving in the rear direction 7 resisting against the first force F1, in the movement process during which the movable member 53 is moved from the third position to the fourth position.

Here, there is such a fear that any variation might occur in the movement completion timing to the second position among the respective roller holders 85, due to the position at which the force is applied to the movable member 53 during the movement of the movable member 53, any variation in the dimension (size) of the movable member 53, etc. In a case that the length, of the first inclined surface 81, in the front direction 6 and rear direction 7 is designed to be substantially same as the minimum length required for the roller holder 85 to move from the first position to the second position, despite the fear that such variation might occur, there is a fear that the following problem might be generated. Namely, in a case that the above-described variation occurs, a roller holder 85 which is included in the roller holders 85 and which has passed the first inclined surface 81 before another roller holder(s) 85 and has already reached the second position might be made to return to the first inclined surface 81 by being influenced by the first force F1 which is acting on the movable member 53 by the another roller holder(s) 85 which is (are) still moving along the first inclined surface 81.

In view of this situation, the embodiment provides the second inclined surface 82 on the cam portion 74. The roller holder 85 which is moved to the second position by being guided by the first inclined surface 81 is separated from the first inclined surface 81 and abuts against the second inclined surface 82. In this situation, the roller holder 85 is pressed against the second inclined surface 82 by the urging force of the coil spring 86. With this, a force F2 (see FIG. 8) along the second inclined surface 82 acts on the roller holder 85. Namely, a force in the reverse direction to the direction for returning to the first inclined surface 81 acts on the roller holder 85. Since the force F2 acts on the roller holder 85 which has passed the first inclined surface 81, it is possible to lower any possibility that this roller holder 85 is made to return to the first inclined surface 81.

Further, according to the embodiment, when the movable member 53 is moved in the front direction 6 from the third position toward the forth position, the force in the front direction 6 is applied to the movable member 53 by the lever 54 at the both end portions in the right and left directions 8 and 9 of the movable member 53. With this, there is such a fear that the movable member 53 might be in a warped state such that the central portion in the right and left directions 8 and 9 of the movable member 53 is located on the rear side, in the rear direction 7, of the both end portions in the right and left directions 8 and 9 of the movable member 53. As a result, there is such a fear that any variation might occur in the movement completion timing to the second position among the respective roller holders 85. Specifically, the movement completion timing to the second position regarding a certain roller holder 85, among the roller holders 85, which is located on the central side in the right and left directions 8 and 9 is delayed as compared with the movement completion timing to the second position regarding other roller holders 85 which are located on the outer sides in the right and left directions 8 and 9. However, as described above, even if such a variation occurred, it is possible to lower the possibility that a roller holder 85 which has passed the first inclined surface 81 before another roller holder(s) 85 and has already reached the second position is made to return to the first inclined surface 81.

Further, according to the embodiment, the movable member 53 is brought into a slidable contact with the support frame 51. Thus, the relative positioning accuracy of the roller holders 85 relative to the movable member 53 can be enhanced. With this, the possibility that the roller holder(s) 85 is/are made to return to the first inclined surface 81 can be lowered.

First Modification

In the above-described embodiment, the inclination angle with respect to the front and rear directions 6 and 7 is same among the respective first inclined surfaces 81. However, the inclination angle with respect to the front and rear directions 6 and 7 may be different among the respective first inclined surfaces 81.

Note that in the following description, as depicted in FIG. 4, two roller holders 85 included in the six roller holders 85 and arranged on the central side in the right and left directions 8 and 9 are each referred to as a "roller holder 85A", two roller holders 85 included in the six roller holders 85 and arranged on the outer sides of the roller holders 85A respectively in the right and left directions 8 and 9 are each referred to as a "roller holder 85B", and two roller holders 85 included in the six roller holders 85 and arranged on the outer sides of the roller holders 85B respectively in the right and left directions 8 and 9 are each referred to as a "roller holder 85C". Further, cam portions 74 included in the cam portions 74 and provided corresponding to the roller holders 85A are each referred to as a "cam portion 74A", cam portions 74 included in the cam portions 74 and provided corresponding to the roller holders 85B are each referred to as a "cam portion 74B", and cam portions 74 included in the cam portions 74 and provided corresponding to the roller holders 85C are each referred to as a "cam portion 74C".

Figure 11B:
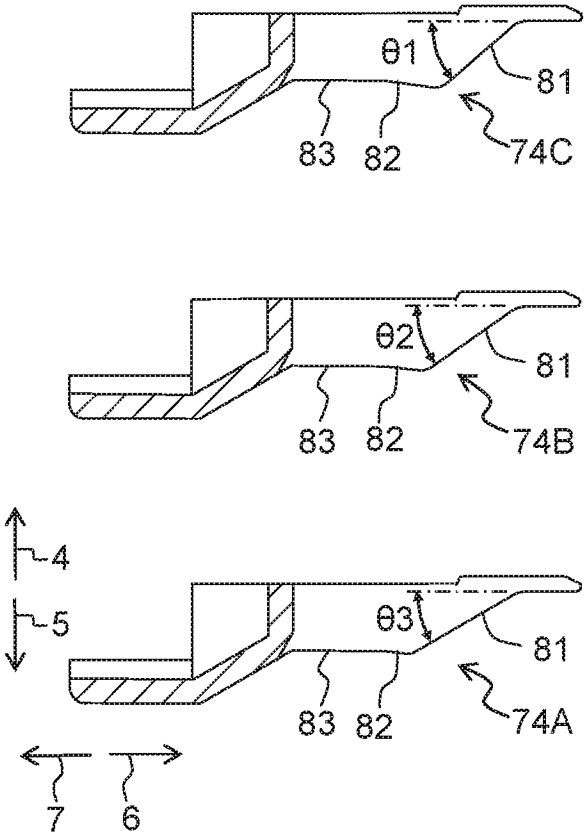
FIG. 11B is a cross-sectional view schematically depicting cam portions 74 in a second modification.
Figure 11A:
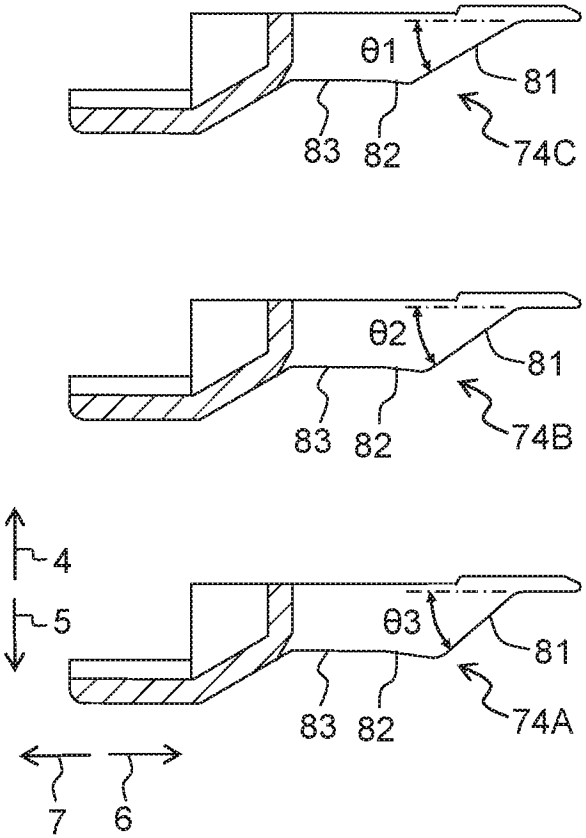
FIG. 11A is a cross-sectional view schematically depicting cam portions 74 in a first modification.

In a first modification, as depicted in FIG. 11A, an inclination angle θ3 with respect to the front and rear directions 6 and 7 of the first inclined surface 81 of the cam portion 74A is greater than an inclination angle η2 with respect to the front and rear directions 6 and 7 of the first inclined surface 81 of the cam portion 74B. Further, the inclination angle η2 is greater than an inclination angle θ1 with respect to the front and rear directions 6 and 7 of the first inclined surface 81 of the cam portion 74C. Note that the inclination angle η2 may be same as the inclination angle θ1 and smaller than the inclination angle θ3. Alternatively, the inclination angle θ2 may be same as the inclination angle θ3 and greater than the inclination angle θ1. Further, in the first modification, it is allowable that at the roller holders 85 and the cam portions 74 are arranged in such a manner that at least one piece of each of the roller holder 85 and the cam portion 74 is arranged on the central side in the right and left directions 8 and 9, and at least two pieces of each of the roller holder 85 and the cam portion 74 are arranged on the outer sides of the central side, respectively, in the right and left directions 8 and 9. Namely, it is allowable that at least three pieces of each of the roller holder 85 and the cam portion 74 are provided.

In a case that the central portion, of the movable member 53, in the right and left directions 8 and 9 is bent such that the central portion is located on the rear side, in the rear direction 7, relative to the both end portions in the right and left directions 8 and 9 of the movable member 53, there is such a fear that the movement completion timing to the second position regarding the roller older 85A might be delayed as compared with the movement completion timing to the second position regarding the roller holder 85C. According to the first modification, however, the inclination angle θ3 of the first inclined surface 81 abutting against the roller holder 85A is greater than the inclination angle θ1 of the first inclined surface 81 abutting against the roller holder 85C, and thus the roller holder 85A reaches the second position at an early stage. As a result, it is possible to lower the above-described delay in the movement completion timing.

Second Modification

The magnitude relationship among the respective cam portions 74 regarding the inclination angle of the first inclined surface 81 relative to the front and rear directions 6 and 7 may be opposite to that of the first modification. Namely, in a second modification, the inclination angle θ1 is greater than the inclination angle θ2, as depicted in FIG. 11B. Further, the inclination angle θ2 is greater than the inclination angle θ3. Note that the inclination angle θ2 may be same as the inclination angle θ1 and may be greater than the inclination angle θ3. Alternatively, the inclination angle θ2 may be same as the inclination angle θ3 and may be smaller than the inclination angle θ1. Further, in the second modification, it is allowable that at least three pieces of the roller holder 85 and at least three pieces of the cam portion 74 are provided, in a similar manner in the first modification.

According to the second modification, the inclination angle θ1 of the first inclined surface 81 abutting against the roller holder 85C is greater than the inclination angle θ3 of the first inclined surface 81 abutting against the roller holder 85A. Therefore, the roller holder 85C reaches the second position at an early stage and abuts against the second inclined surface 82. With this, the above-described force F2 (see FIG. 8) acts on the right and left end portions in the movable member 53. As a result, any bending of the movable member 53 such that the central portion in the right and left directions 8 and 9 is located on the rear side in the rear direction 7 relative to the both end portions in the right and left directions 8 and 9 is lowered. Further, since the above-described force F1 (see FIG. 8) ceases to act on the right and left end portions in the movable member 53, the movable member 53 can be easily moved toward the fourth direction. As a result, it is possible to lower the above-described delay in the movement completion timing to the second position regarding the roller holder 85A.

Third Modification

In the embodiment, the positions of the front and rear end portions of the respective inclined surfaces 81 are same. It is allowable, however, that the positions of the front and rear end portions of the respective inclined surfaces 81 may be different from one another.

Figure 12A:
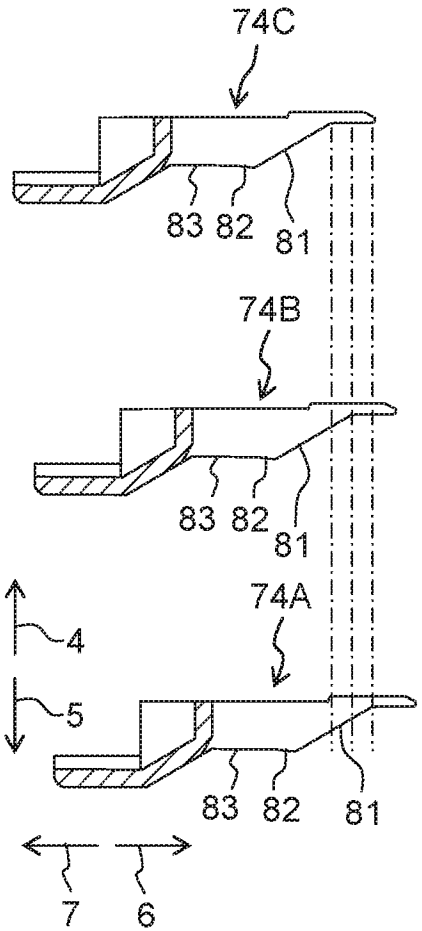
FIG. 12A is a cross-sectional view schematically depicting cam portions 74 in a third modification.

In a third modification, as depicted in FIG. 12A, the position of the front end portion of the first inclined surface 81 of the cam portion 74A is located on the front side in the front direction 6 relative to the position of the front end portion of the first inclined surface 81 of the cam portion 74B. Further, the position of the front end portion of the first inclined surface 81 of the cam portion 74B is located on the front side in the front direction 6 relative to the position of the front end portion of the first inclined surface 81 of the cam portion 74C. Note that the position of the front end portion of the first inclined surface 81 of the cam portion 74B may be located to be same as the position of the front end portion of the first inclined surface 81 of the cam portion 74C, and may be located on the rear side in the rear direction 7 relative to the position of the front end portion of the first inclined surface 81 of the cam portion 74A. Alternatively, the position of the front end portion of the first inclined surface 81 of the cam portion 74B may be located to be same as the position of the front end portion of the first inclined surface 81 of the cam portion 74A, and may be located on the front side in the front direction 6 relative to the position of the front end portion of the first inclined surface 81 of the cam portion 74C. Further, in the third modification, it is allowable that at least three pieces of the roller holder 85 and at least three pieces of the cam portion 74 are provided, in a similar manner in the first modification.

In a case that the movable member 53 is bent in such a state that the central portion in the right and left directions 8 and 9 of the movable member 53 is located on the rear side in the rear direction 7 relative to the both end portions in the right and left directions 8 and 9 of the movable member 53, then when the movable member is moving from the third position toward the fourth position, there is such a fear that the movement completion timing to the second position regarding the roller holder 85A might be delayed as compared with the movement completion timing to the second position regarding the roller holder 85C. According to the third modification, however, the roller holder 85A is allowed to abut against the first inclined surface 81 and is guided by the first inclined surface 81 at an early timing. Accordingly, the roller holder 85A reaches the second position at an early stage. As a result, it is possible to lower the above-described delay in the movement completion timing.

Fourth Modification

Figure 12B:
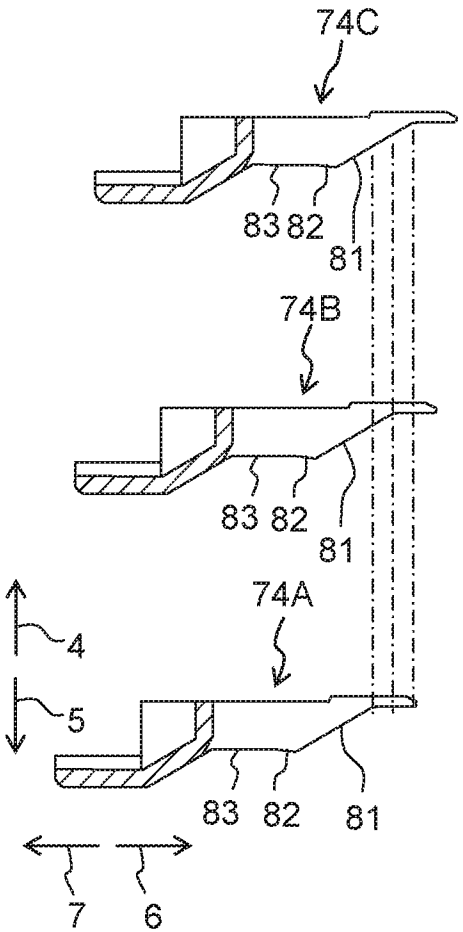
FIG. 12B is a cross-sectional view schematically depicting cam portions 74 in a fourth modification.

The positional relationship among the respective cam portions 74 regarding the position of the front end portion of the first inclined surface 81 may be opposite to that of the third modification. Namely, in a fourth modification, as depicted in FIG. 12B, the position of the front end portion of the first inclined surface 81 of the cam portion 74C is located on the front side in the front direction 6 relative to the position of the front end portion of the first inclined surface 81 of the cam portion 74B. Further, the position of the front end portion of the first inclined surface 81 of the cam portion 74B is located on the front side in the front direction 6 relative to the position of the front end portion of the first inclined surface 81 of the cam portion 74A. Note that the position of the front end portion of the first inclined surface 81 of the cam portion 74B may be same as the position of the front end portion of the first inclined surface 81 of the cam portion 74A and may be located on the rear side in the rear direction 7 relative to the position of the front end portion of the first inclined surface 81 of the cam portion 74C. Alternatively, the position of the front end portion of the first inclined surface 81 of the cam portion 74B may be same as the position of the front end portion of the first inclined surface 81 of the cam portion 74C and may be located on the front side in the front direction 6 relative to the position of the front end portion of the first inclined surface 81 of the cam portion 74A. Further, in the fourth modification, it is allowable that at least three pieces of the roller holder 85 and at least three pieces of the cam portion 74 are provided, in a similar manner in the first modification.

According to the fourth modification, since the roller holder 85C abuts against and is guided by the first inclined surface 81 at an early timing, the roller holder 85C reaches the second position and abuts against the second inclined surface at an early stage. With this, the above-described force F2 (see FIG. 8) as described above acts on the right and left end portions in the movable member 53. As a result, any bending of the movable member 53 such that the central portion in the right and left directions 8 and 9 of the movable member 53 is located on the rear side in the rear direction 7 relative to the both end portions in the right and left directions 8 and 9 of the movable member 53 is lowered. Further, since the above-described force F1 (see FIG. 8) ceases to act on the right and left end portions in the movable member 53, the movable member 53 can be easily moved toward the fourth direction. As a result, it is possible to lower the above-described delay in the movement completion timing to the second position regarding the roller holder 85A.

Fifth Modification

Figure 12C:
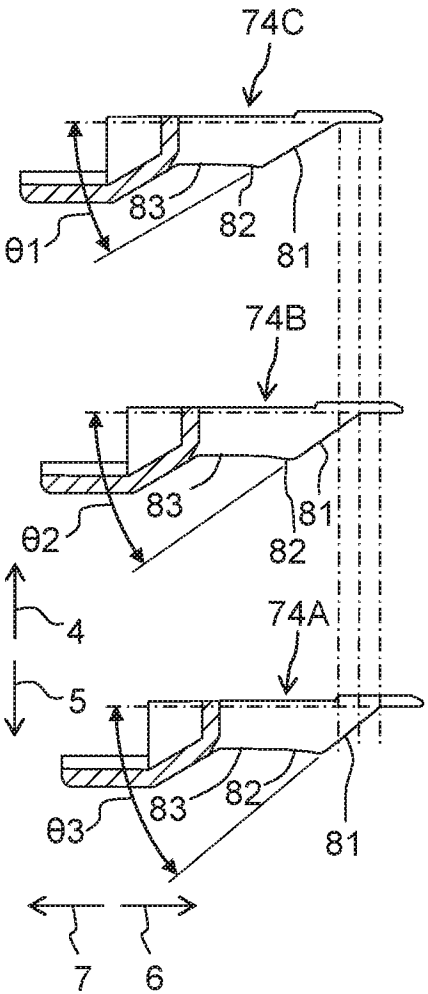
FIG. 12C is a cross-sectional view schematically depicting cam portions 74 in a fifth modification.

The first to fourth modifications may be combined appropriately. For example, as depicted in FIG. 12C, the position of the front end portion of the first inclined surface 81 of the cam portion 74A may be located at the front side in the front direction 6 relative to the position of the front end portion of the first inclined surface 81 of the cam portion 74B, and the inclination angle θ3 may be greater than the inclination angle θ2. Further, the position of the front end portion of the first inclined surface 81 of the cam portion 74B may be located at the front side in the front direction 6 relative to the position of the front end portion of the first inclined surface 81 of the cam portion 74C, and the inclination angle θ2 may be greater than the inclination angle θ1.

Other Modifications

In the above-described embodiment, the movable member 53 is configured to move in the front and rear directions 6 and 7 by being abutted by the lever 54. The means for moving the movable member 53, however, it not limited to the configuration including the lever 54. For example, the movable member 53 may be connected to a rod member exposed to the outside of the casing 14 via the opening 13. Further, when a user moves the rod member in the front and rear directions 6 and 7, the movable member 53 may be moved in the front and rear directions 6 and 7 by accompanying with such a movement of the rod member by the user.

In the above-described embodiment, in the conveyance roller pair 59, the conveyance roller 60 is arranged at the upper side in the up direction 4 relative to the pinch rollers 61. However, the pinch rollers 61 may be arranged on the upper side in the up direction 4 relative to the conveyance roller 60. In such a case, it goes without saying that the arrangements of the roller holders 85, the movable member 53, etc. are consequently also changed in accordance with the arrangement location of the pinch rollers 61.

What is claimed is:

1. A conveyance apparatus comprising:

a conveyance roller;

a plurality of driven rollers arranged to face the conveyance roller and arranged side by side to each other in an axial direction of the conveyance roller;

a plurality of roller holders arranged side by side to each other in the axial direction, configured to support the driven rollers to be rotatable, respectively, and configured to be movable to a first position at which the driven rollers abut against the conveyance roller and to a second position at which the driven rollers are separated from the conveyance roller;

a biasing member configured to bias each of the roller holders toward the first position; and a movable member configured to be movable to a third position and to a fourth position along an orthogonal direction orthogonal to the axial direction, the movable member having a plurality of cam portions which are disposed corresponding to the roller holders, respectively, and which are configured to abut against the roller holders respectively in a movement process during which the movable member is moved from the third position to the fourth position to thereby move the roller holders from the first position to the second position, wherein each of the cam portions includes:

a first inclined surface inclined in a direction approaching toward one of the driven rollers in a moving direction of the movable member moving from the third position toward the fourth position, and configured to abut against one of the roller holders from a side of one of the driven rollers corresponding thereto, during the movement process of the movable member from the third position to the fourth position, to thereby move one of the roller holders from the first position toward the second position; and a second inclined surface arranged upstream of the first inclined surface in the moving direction, inclined in a direction separating away from one of the driven rollers in the moving direction, and configured to abut against one of the roller holders from the side of one of the driven rollers, during the movement process of the movable member from the third position to the fourth position.

2. The conveyance apparatus according to claim 1, further comprising an applying member which is configured to abut against both end portions, in the axial direction, of the movable member and which is configured to apply, to the both end portions, a force in the orthogonal direction orthogonal to the axial direction to thereby move the movable member to the third position and to the fourth position.

3. The conveyance apparatus according to claim 2, wherein the roller holders and the cam portions are provided as at least three roller holders and at least three cam portion, a cam portion, among the at least three cam portions, arranged on a central side in the axial direction includes an inclination angle of the first inclined surface relative to the moving direction which is greater than an inclination angle of the first inclined surface relative to a moving direction of another cam portion, among the at least three cam portions, arranged on an outer side in the axial direction.

4. The conveyance apparatus according to claim 2, wherein the roller holders and the cam portions are provided as at least three roller holders and at least three cam portions, a cam portion, among the at least three cam portions, arranged on an outer side in the axial direction includes an inclination angle of the first inclined surface relative to the moving direction which is greater than an inclination angle of the first inclined surface relative to a moving direction of another cam portion, among the at least three cam portions, arranged on a central side in the axial direction.

5. The conveyance apparatus according to claim 2, wherein the roller holders and the cam portions are provided as at least three roller holders and at least three cam portions, a cam portion, among the at least three cam portions, arranged on an central side in the axial direction includes a downstream end portion, in the moving direction of the first inclined surface, of which position is located downstream in the moving direction of a position of a downstream end portion in the moving direction of the first inclined surface of another cam portion, among the at least three cam portions, arranged on an outer side in the axial direction.

6. The conveyance apparatus according to claim 2, wherein the roller holders and the cam portions are provided as at least three roller holders and at least three cam portions, a cam portion, among the at least three cam portions, arranged on an outer side in the axial direction includes a downstream end portion, in the moving direction of the first inclined surface, of which position is located downstream in the moving direction of a position of a downstream end portion in the moving direction of the first inclined surface of another cam portion, among the at least three cam portions, arranged on a central side in the axial direction.

7. The conveyance apparatus according to claim 1, further comprising a support frame configured to support each of the roller holders and the biasing member, wherein the movable member is movable to the third position and to the fourth position while slidably contacting the support frame along the orthogonal direction orthogonal to the axial direction.

8. An image recording apparatus comprising:

the conveyance apparatus as defined in claim 1; and a recording section configured to record an image on a sheet which is being conveyed by the conveyance roller and the plurality of driven rollers.

* * * * *